US005750969A

United States Patent [19]

Lee

[11] Patent Number: 5,750,969

[45] Date of Patent: May 12, 1998

[54] MICROWAVE CHOKE APPARATUS FOR MICROWAVE OVEN

[75] Inventor: Ho Kyeong Lee, Kyungki-Do, Rep. of Korea

[73] Assignee: LG Electronics Inc., Rep. of Korea

[21] Appl. No.: 777,403

[22] Filed: Dec. 27, 1996

[30] Foreign Application Priority Data

Dec. 29, 1995 [KR] Rep. of Korea ..... 67370/1995

[51] Int. Cl.[6] ..... H05B 6/76

[52] U.S. Cl. ..... 219/742; 219/743; 174/35 GC

[58] Field of Search ..... 219/742, 743, 219/741, 744; 174/35 MS, 35 GC

[56] References Cited

U.S. PATENT DOCUMENTS

| | | | |
|---|---|---|---|
| 3,668,357 | 6/1972 | Kobayashi | 219/741 |
| 3,767,884 | 10/1973 | Osepchuk et al. | 219/742 |
| 4,700,034 | 10/1987 | Lee | 219/742 |
| 5,036,171 | 7/1991 | Kim et al. | 219/742 |
| 5,206,478 | 4/1993 | Lee | 219/742 |

FOREIGN PATENT DOCUMENTS

| | | | |
|---|---|---|---|
| 1-118028 | 5/1989 | Japan | 219/741 |

*Primary Examiner*—Philip H. Leung

*Attorney, Agent, or Firm*—Ostrolenk, Faber, Gerb & Soffen, LLP

[57] ABSTRACT

A microwave choke apparatus for a microwave oven includes an inner door panel having a plurality of multi-pronged and double-stepped portions extended outwardly therefrom, between which multi-pronged and double-stepped toothed portions there are alternately formed a plurality of slots, an outer door panel having an upwardly bent portion at an outer periphery thereof, and a choke cover for closing an opening formed between an inner side of the bent portion of the outer door panel and respective outer flat portions of the multi-pronged and double-stepped toothed portions of the inner door panel. The apparatus effectively prevents microwaves from leaking externally through a gap between a door frame and a front panel of the microwave oven by broadening a bandwidth of a choke resonant frequency of a choke channel.

3 Claims, 6 Drawing Sheets

MICROWAVE CHOKE APPARATUS FOR MICROWAVE OVEN

BACKGROUND OF THE INVENTION

1. Field of the Invention

The present invention relates to a microwave oven, and more particularly to a microwave choke apparatus for a microwave oven capable of effectively preventing microwaves from externally leaking through a crack between a door frame and a front panel thereof, irrespective of a gap variation in size occurring during manufacturing.

2. Description of the Prior Art As known in general, a microwave oven is an electric appliance for cooking food placed therein by generating and scanning microwave energy from a magnetron to the food. However, with all the convenience, even minor exposure of the microwave energy generated from the magnetron in a microwave oven to a human body is undesirable and accordingly the microwave energy is required to be completely blocked from leaking.

In a conventionally available microwave oven there is structurally formed a gap of about 0.1 to 0.5 mm between a door frame and a front panel thereof so that, in order to prevent an undesired external leakage of microwave oven through the gap, there is furnished a microwave choke apparatus along an edge portion of the door to the microwave oven.

As shown in FIG. 1 showing a conventional microwave oven, at a front portion of a microwave oven body 1 including a cooking chamber 8 there is provided a door 2 in which a transparent glass panel 3 is installed.

Referring to FIGS. 2 and 3 respectively showing a microwave choke apparatus of a microwave oven according to the conventional art, between an inner panel 5 and an outer panel 4 of the door 2 there is formed a peripheral rectangularly sectioned choke channel 6 which is closed at one corner by a choke channel cover 7.

A capacitive seal 9 is formed between the inner door panel 5 serving as a front wall of the choke channel 6 and an outer edge portion of a front plate 1' serving as a front portion of the body 1. At an outer peripheral portion of the inner door panel 5 and around an outer peripheral lower portion of the capacitive seal 9 there are formed inwardly stepped portions 5' extended inwardly from the inner panel 5 and having two steps therein extended into the choke channel 6. These stepped portions 5' are in the form of a plurality of projecting teeth **5'*c* each having a width $D_1$ separated by a plurality of slots 5'*d*** each having a width $D_2$.

The teeth **5'*c* and slots 5'*d* together with the choke channel 6 serve to block microwave energy from leaking outwardly past the closed door 2**.

An outer peripheral portion **4*b* of the outer panel 4 is bent into a u-shaped clip so that a sub- capacitive seal 10 can be provided between a front edge of the front plate 1' and a facing edge of the peripheral portion 4*b*. An opening 6' communicating to the choke channel 6 is formed between the inwardly extending stepped faces 5'*b* of the teeth 5'*c* and an inner peripheral face of the outer portion 4*b* of the outer plate 4. The opening 6' can be closed by the choke cover 7** formed of a plastic material.

The operational principles of the conventional microwave choke apparatus of a microwave oven will be now described.

The choke channel 6 causes impedance of microwaves entering the gap between the door and body to be significantly larger to thereby serve to block them from passing therethrough outwardly and instead to be fed back into the cooking chamber 8.

Specifically, the microwaves in the cooking chamber 8 pass through the opening 6' into the choke channel 6 and are reflected against the choke channel wall opposite the opening 6' so that there occurs an interference and a converted impedance at the opening 6' in accordance with the phase and magnitude difference between the microwaves passing in and out the opening 6'.

Therefore, an adjusted length of the choke channel 6 may cause the impedance to significantly increase and accordingly the microwaves may not be leaked externally but fed back to the cooking chamber 8. Here, because it is impossible to have a large enough impedance for every frequency, the choke channel 6 is generally designed to have a maximum impedance around a frequency of 2450 MHz (x-band) which is applicable to a general microwave oven. Meanwhile, the microwave power adapted in a general microwave oven is set at about 600 Watts and also the microwave energy which is externally leaked through the gap a crack at the door 2 is designed not to exceed 1 mV at most.

As shown in FIG. 4, the microwave choke characteristic exhibits a maximum attenuation at a central frequency and as the distance from the central frequency increases the leakage amount becomes larger.

Here, the bandwidth denotes the frequency range in which less than an allowed value of microwave energy is leaked, and the bandwidth in FIG. 4 ranges from f2 to f3.

In a magnetron which generates microwaves in a microwave oven, the oscillating frequency is characteristically changed up and down around a center frequency of 2450 MHz so that when the oscillating frequency generated by the magnetron deviates from the above bandwidth, microwave energy may be externally leaked. Therefore, a wider bandwidth for the choke channel 6 may serve to prevent the microwave energy from externally leaking.

With reference to FIG. 7, the flow of microwave energy being leaked from the cooking chamber to the exterior can be incorporated into a pointing vector expression as follows.

$$\vec{S}=\vec{E}\times\vec{H}^* \; [mW/Cm^2]$$

wherein, $\vec{S}$ denotes the z-axis component (propagating direction), $\vec{E}$ denotes the electric field in the x-axis, and $\vec{H}$ denotes the magnetic field in the y-axis, and the symbol * denotes a complex conjugate.

At this time, to prevent such vector components, there are required respective chokes for blocking microwaves from moving in the x- and z- axes.

Conventionally, the plurality of teeth **5'*c* and slots 5'*d* periodically formed and having a certain interval therebetween in the stepped portions 5'** serve as a band stop filter against the x-axially flowing microwaves to thereby prevent leakage of the microwaves.

As shown in FIG. 6, in a fringing capacitance formed in accordance with the periodic slot structure including the stepped portions 5' having the same distances therebetween, there occur fringing capacitors $C_1$ and $C_2$ between the front plate 1' and the teeth **5'*c*, and there also occur fringing capacitors $C_3$ and $C_4$ between the teeth 5'*c* and the long vertical wall 4*d* of the choke channel 6 extended from the outer door panel 4**.

The filter operation of such a periodic slot structure can be explained by Floguet's Theorem.

That is, referring to an ω-β dispersion relation in accordance with such a structure, β becomes an imaginary value in a certain band in which microwave radiation is attenuated so that the ω-β dispersion relation creates a function of $D_1$ which denotes a width of the vertical tooth portion 5'c of the respective stepped portions 5' and $D_2$ denoting a slot width between the respective stepped tooth portions 5'c.

Accordingly, such a structure provides attenuation of microwaves at around 2450 MHz which is applicable to a microwave oven serves as a band stop filter to thereby prevent the leakage of microwaves along the x-axis.

Also, in the z-axial choke, a $$\frac{\lambda g}{4}$$

choke seal serves as a main part, and when microwaves flow from point A closer to the cooking chamber 8 to point C, as shown in FIG. 7, the impedance relation can be expressed as jx and when an infinite value point of jx is positioned on a path of $\overrightarrow{A\blacksquare C}$ the transfer path of $\overrightarrow{A\blacksquare C}$ becomes open, thereby blocking the leakage of microwaves.

The conventional $$\frac{\lambda g}{4}$$

choke seal includes the capacitive seals 9, 10 and is provided with the stepped tooth portions 5'b, 5'c having periodic slots 5'd therebetween.

At this time, when forming the choke seal having such a structure, as shown in FIG. 5, crucial factors may be the length L and width W of the choke channel 6 and the height H between the outer flat end portions 5'b of the stepped tooth portions 5'c and the inner side of the outer horizontal portion 4c extended from the outer door panel 4. Other crucial factors in forming the periodic slots 5'd and the first and second capacitive seals 9, 10 may be $D_1$, $D_2$, E and the vertical portion of the inner plate 5.

In the conventional microwave choke apparatus of a microwave oven, the choke channel 6 is formed to block microwaves from leaking and a band stop filter is applicable to such a choke channel structure.

That is, the structure of the choke channel 6, the step portions 5' and the slots 5'd is applied as a λ/4 structure, and although the door 2 and the front plate 1' of the microwave oven are not mechanically abutted to each other, microwaves cannot externally leak due to an electrical short circuit.

However, the conventional microwave choke apparatus of a microwave oven has a narrow bandwidth due to the identical length of the periodic step portions 5' which are formed in the structure.

That is, when in manufacturing a microwave oven there results a change in the height of the opening 6' (measured between the stepped portion 5' and the bent portion 4b) at the entrance to the choke channel 6, an attenuation curve of the microwaves from the cooking chamber 8 exhibits a slight deviation from the central frequency, as shown in FIG. 9, resulting in a rapid deterioration (a rapid increase in attenuation) in the function of the microwave choke. In FIG. 9, H2 denotes the choke characteristic caused by the stepped portion 5' having a certain length, and H1 denotes the choke characteristic caused by a step portion 5' longer than H2.

Further, in the conventional microwave choke apparatus, skewed measurements of components due to production deviation may lead to a serious deflection in the choke characteristics of individual microwave ovens.

SUMMARY OF THE INVENTION

Accordingly, it is an object of the present invention to provide a microwave choke apparatus for a microwave oven capable of effectively preventing microwave energy from leaking externally through a gap between a door frame and a front panel thereof by widening a choke frequency bandwidth of a choke channel.

To achieve the above-described object, the microwave choke apparatus for a microwave oven according to the present invention includes an inner door panel having a plurality of multi-pronged and two-stepped portions extended outwardly therefrom, between which multi-pronged and two-stepped portions there are alternately formed a plurality of slots, an outer door panel having a bent portion at an outer peripheral portion thereof, and a choke cover for closing an opening formed between an inner side of the bent portion of the outer door panel and a respective outer flat portion of the multi-pronged and two-stepped portions of the inner door panel.

DETAILED DESCRIPTION OF THE INVENTION

With reference to the accompanying drawings, the microwave choke apparatus for a microwave oven according to the present invention will be described, wherein only characteristic features which are not shown in the conventional apparatus will be explained.

Figure 1:
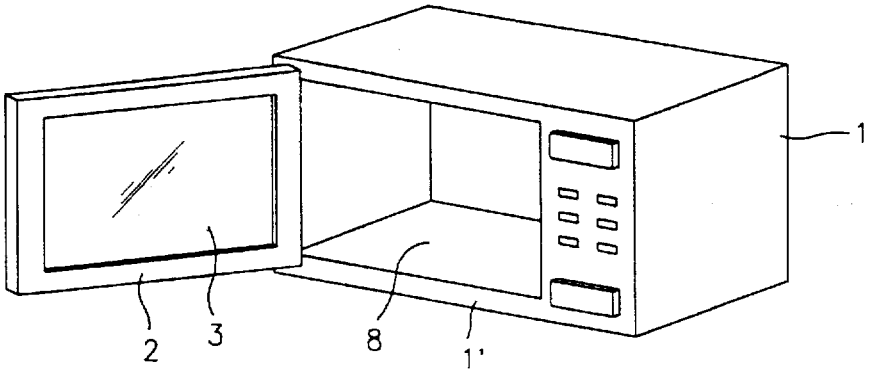
FIG. 1 CONVENTIONAL ART
FIG. 1 is a perspective view of a conventional microwave oven with its door open.
Figure 2:
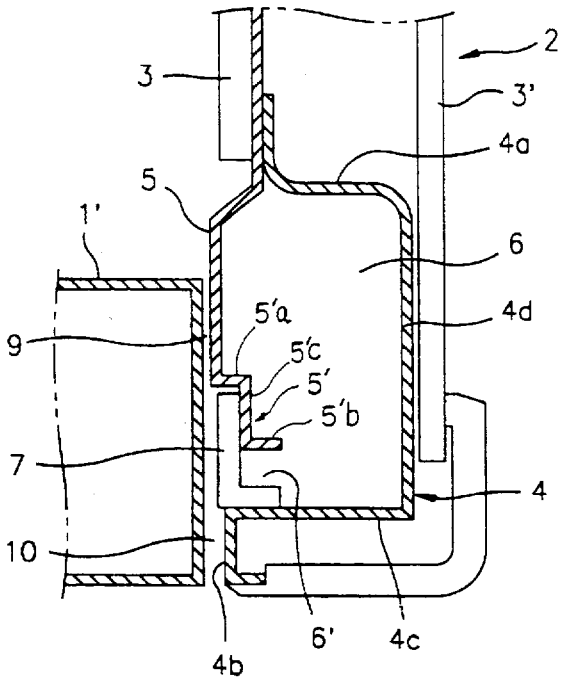
FIG. 2 CONVENTIONAL ART
FIG. 2 is a cross-sectional partial view showing the structure of a conventional microwave choke of a microwave oven.
Figure 3:
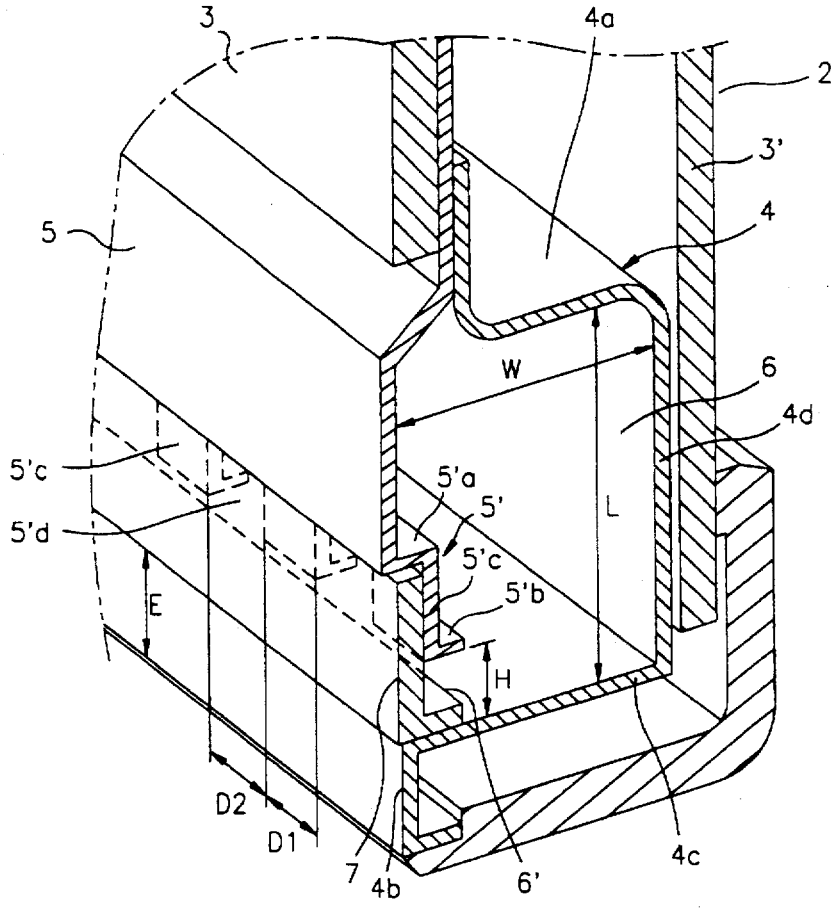
FIG. 3 CONVENTIONAL ART
FIG. 3 is a partial perspective view showing the structure of the conventional microwave choke of a microwave oven.
Figure 4:
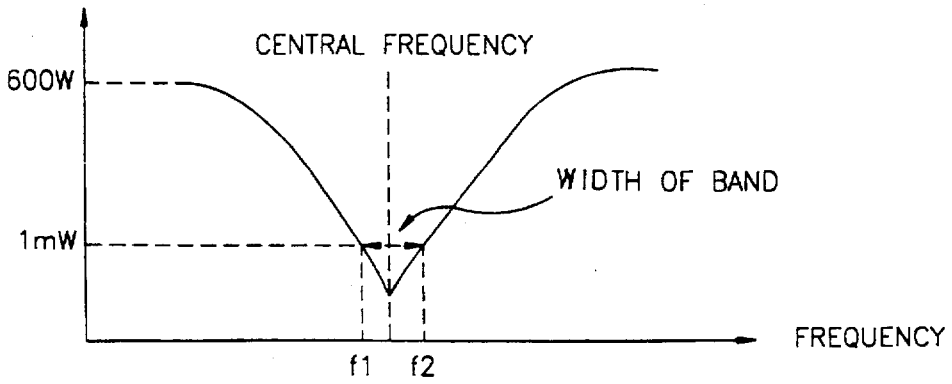
FIG. 4 CONVENTIONAL ART
FIG. 4 is a graph illustrating a conventional microwave choke characteristic, wherein a choke amount decreases with distance from a central frequency.
Figure 5:
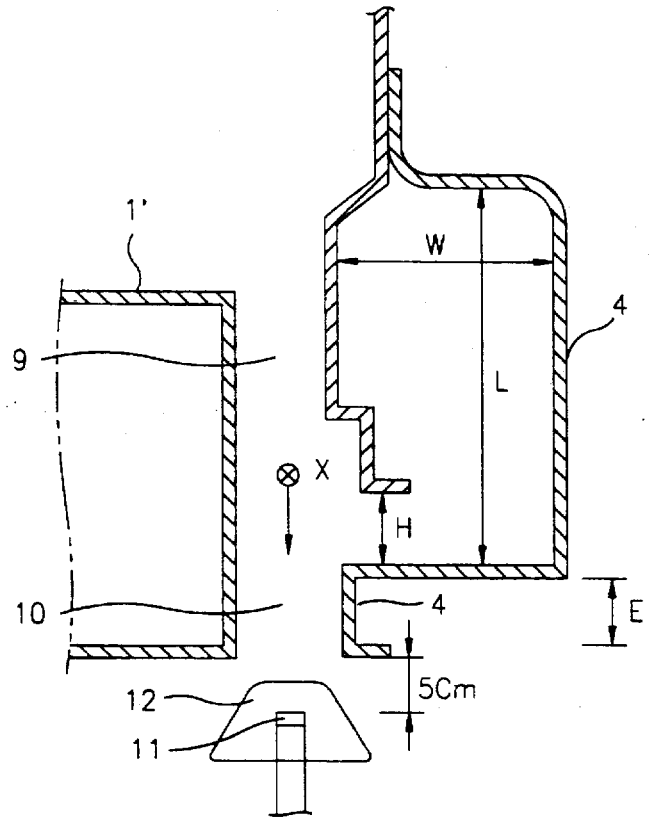
FIG. 5 CONVENTIONAL ART
FIG. 5 is a cross-sectional exemplary view showing an optimal structure of a conventional microwave choke.
Figure 6:
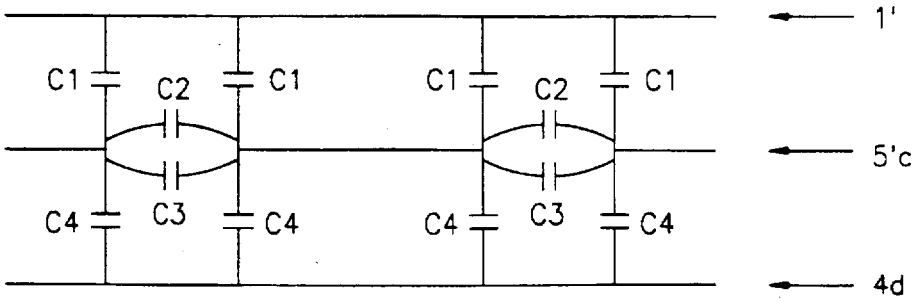
FIG. 6 CONVENTIONAL ART
FIG. 6 is a schematic circuit diagram showing an equivalent fringing capacitance formed by slots provided in a conventional microwave choke apparatus.
Figure 7:
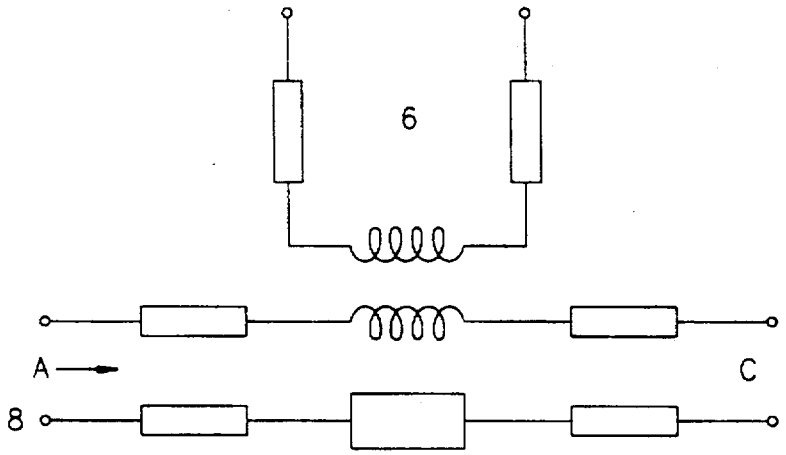
FIG. 7 CONVENTIONAL ART
FIG. 7 is a schematic circuit diagram showing microwaves propagating from a cooking chamber to the exterior.
Figure 8:
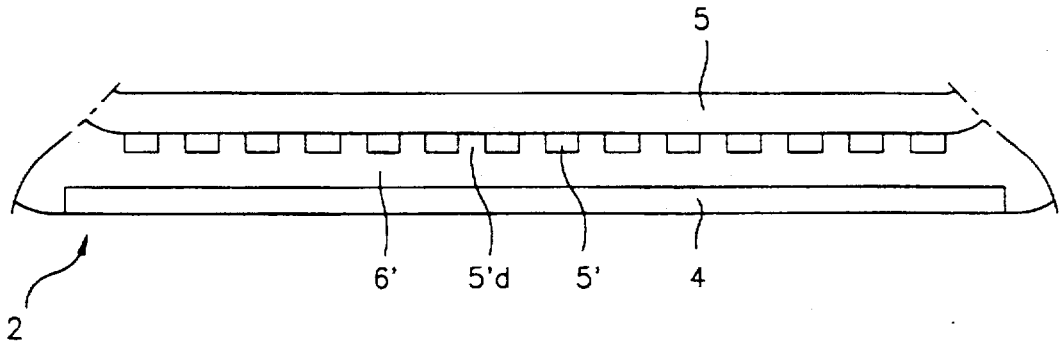
FIG. 8 CONVENTIONAL ART
FIG. 8 is a partial front plan view showing a structure of a conventional microwave choke apparatus of a microwave oven.
Figure 9:
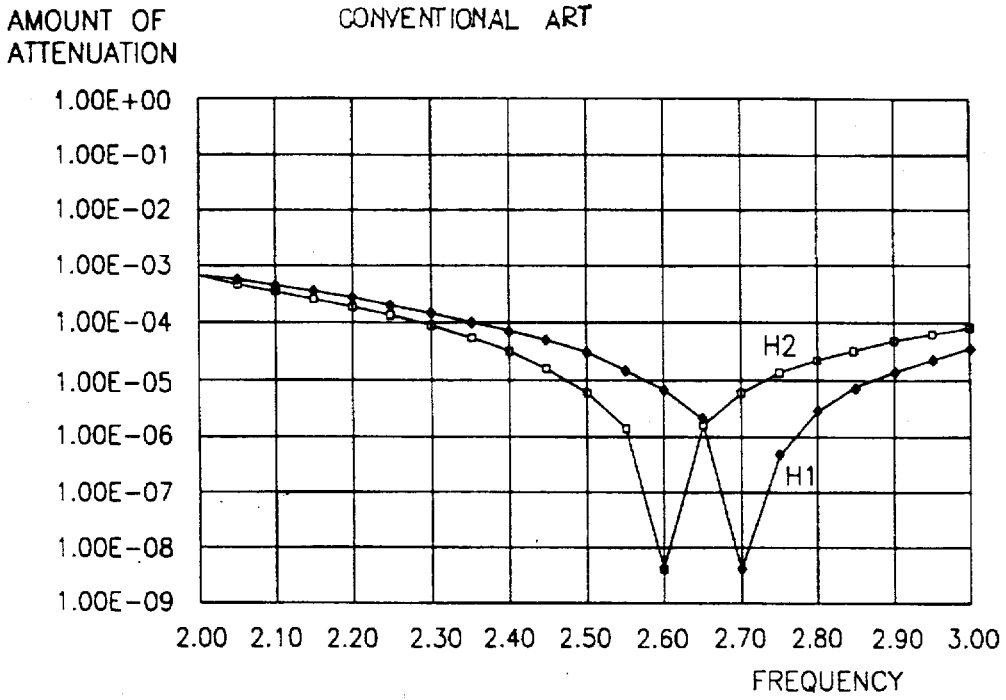
FIG. 9 CONVENTIONAL ART
FIG. 9 is a graph illustrating a choke characteristic of a conventional microwave choke apparatus according to a microwave oven.
Figure 10:
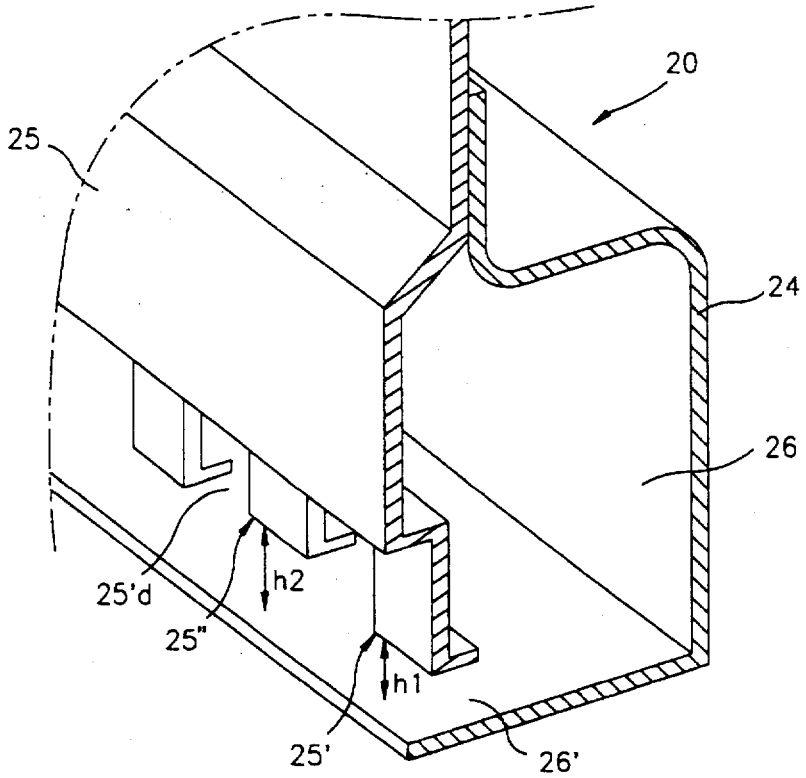
FIG. 10 is a partial sectional perspective view of the construction of a microwave choke apparatus of a microwave oven according to the present invention.
Figure 11:
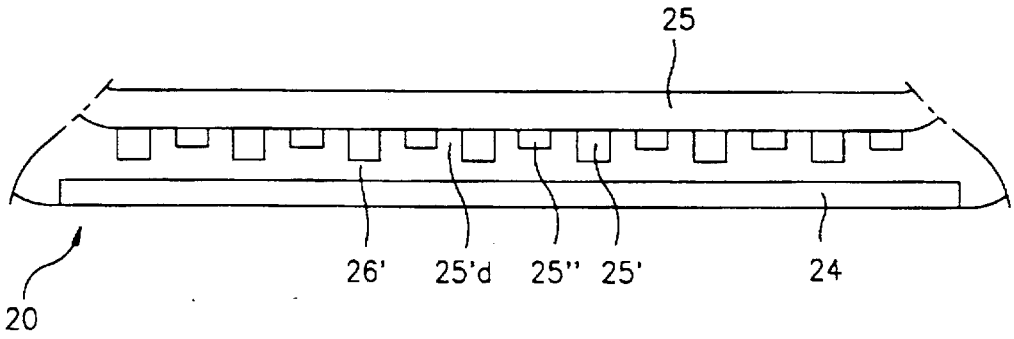
FIG. 11 is a partial front plan view showing the structure of a microwave choke of a microwave oven according to the present invention.

As shown in FIGS. 10 and 11, a plurality of stepped tooth portions 25', 25" extended respectively from an inner door panel 25 for forming a choke channel 26 provided in a door 20 and having respectively longer and shorter lengths relative to each other are periodically arrayed in a row, and there is alternately provided a plurality of slots 25d between the respective stepped tooth portions 25' and 25". It is an important feature of the present invention that the respective heights h1, h2 between the teeth portions 25', 25" and an inner face 26' of the outer peripheral wall of the choke channel 26 have periodic differences from each other. Reference numeral 24 denotes an outer door panel.

The operation and effect of the microwave choke apparatus for a microwave oven according to the present invention will be described.

Figure 12:
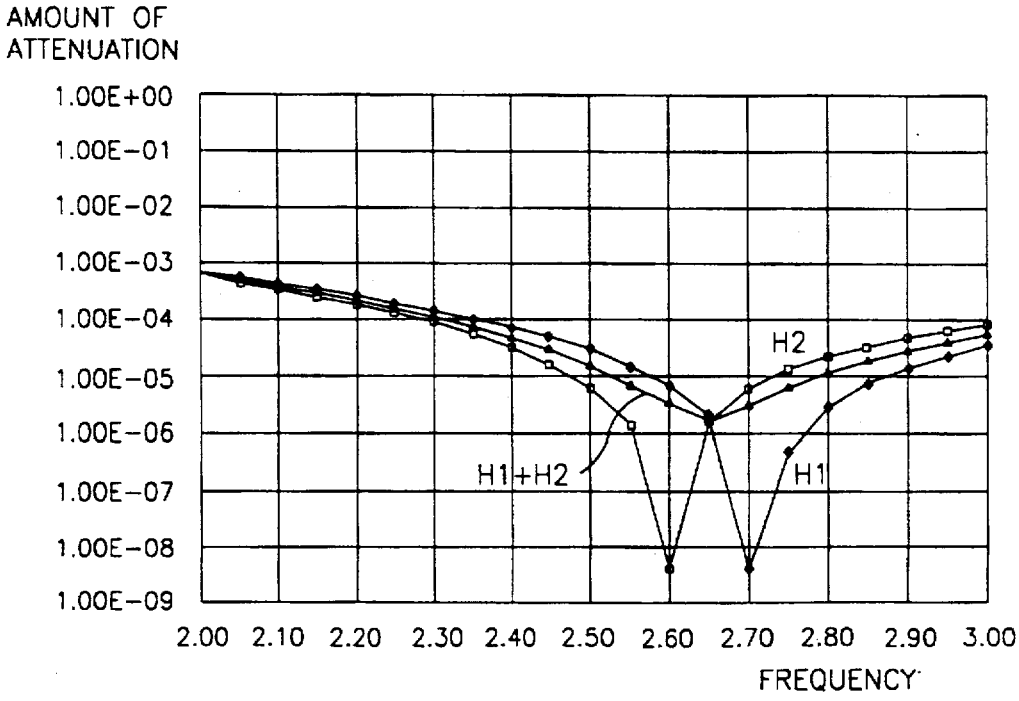
FIG. 12 is a graph illustrating a choke characteristic of the microwave choke of a microwave oven according to the present invention.

As shown in FIG. 12, the microwave choke apparatus exhibits a choke characteristic curve H1 in accordance with the longer stepped tooth portions 25' and a choke characteristic curve H2 in accordance with the shorter stepped tooth portions 25". As a result, the virtual choke characteristic curve is obtained by summing the two choke characteristic curves (H1+H2) of the stepped tooth portions 25', 25".

A slight deviation in the resonant microwave frequency from a central frequency causes the choke characteristic curves H1 and H2 which have more than 10 dB not to show up and instead there is produced a choke characteristic curves of H1+H2 which has a wider microwave choke bandwidth by summing the choke characteristics of the two stepped tooth portions 25', 25".

That is, the different respective lengths of the stepped tooth portions 25', 25" result in a wider microwave choke bandwidth for thereby blocking microwave leakage more efficiently.

Therefore, although a central frequency of a microwave oven is moved to a further extent in accordance with a measured deflection of the stepped tooth portions 25', 25" during mass production, a functional difference between mass-produced microwave ovens with regard to blocking microwave leakage can be overcome in accordance with the widened microwave choke bandwidth.

As described above, the microwave choke apparatus for a microwave oven according to the present invention does not have a functional difference in blocking microwave energy from leaking with regard to mass-produced microwave ovens irrespective of tolerance differences in manufacture due to the widened microwave choke bandwidth, by varying the lengths of the stepped tooth portions which are alternately and periodically formed and separated by the slots.

What is claimed is:

1. A microwave choke apparatus for a microwave oven, comprising:

an inner door panel having a plurality of teeth extending outwardly therefrom, an outer door panel spaced from the inner door panel and bent at an outer peripheral portion thereof toward a choke channel formed between the outer door panel and the inner door panel;

said teeth having respective length dimensions and each of said teeth being spaced away from the outer peripheral portion of said outer door panel defining an opening, a first plurality of said teeth having a length different from a length of a second plurality of said teeth and including slots formed between the teeth; and a choke cover closing the choke channel and having an opening portion formed between an inner side of the bent portion of the outer panel and respective outer flat end portions of the teeth of the inner door panel.

2. The apparatus of claim 1, wherein the teeth are double-stepped teeth.

3. The apparatus of claim 2, wherein the teeth extend along a line and alternate ones of the teeth have comparatively longer lengths.

* * * * *